US006899591B2

(12) United States Patent
Mitchell

(10) Patent No.: US 6,899,591 B2
(45) Date of Patent: May 31, 2005

(54) SEAMLESS CIRCULAR KNIT GARMENT WITH DIFFERENTIAL TIGHTNESS AREAS AND METHOD OF MAKING SAME

(75) Inventor: John C Mitchell, Asheboro, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/729,836

(22) Filed: Dec. 4, 2003

(65) Prior Publication Data

US 2004/0137822 A1 Jul. 15, 2004

Related U.S. Application Data

(63) Continuation-in-part of application No. 10/093,077, filed on Mar. 7, 2002, now Pat. No. 6,685,535.

(51) Int. Cl.[7] ..... A41C 3/00
(52) U.S. Cl. ..... 450/65; 450/66; 450/75
(58) Field of Search ..... 450/75, 65, 69, 450/70, 72, 73, 76, 156, 20, 131; 2/67, 73, 78.1–78.3, 69; 66/171, 176, 177, 153, 172 E, 170

(56) References Cited

U.S. PATENT DOCUMENTS

| | | | |
|---|---|---|---|
| 22,433 | A | 2/1858 | Yeung et al. |
| 54,303 | A | 12/1866 | Browder, Jr. |
| 2,041,664 | A | 10/1936 | Mendel et al. |
| 2,578,175 | A | 12/1951 | Cuozzi |
| 2,628,357 | A | 2/1953 | Sider |
| 2,701,362 | A | 2/1955 | Cascio |
| 2,764,760 | A | 10/1956 | Kaufman |
| 2,884,927 | A | 5/1959 | Goldstein |
| 2,969,067 | A | 1/1961 | Smith |
| 3,036,575 | A | 5/1962 | Morehouse |
| 3,056,411 | A | 10/1962 | Child |
| 3,108,598 | A | 10/1963 | Sachs |
| 3,119,393 | A | 1/1964 | Bernfeld |
| 3,122,143 | A | 2/1964 | McShea |
| 3,203,423 | A | 8/1965 | Champagne |
| 3,421,513 | A | 1/1969 | Landau |
| 3,425,246 | A | 2/1969 | Knohl |
| 3,500,665 | A | 3/1970 | Braxton et al. |
| 3,537,279 | A | 11/1970 | Epley |
| 4,531,525 | A | 7/1985 | Richards |
| 4,624,115 | A | 11/1986 | Safrit et al. |
| 5,045,019 | A | 9/1991 | Capasso et al. |
| 5,081,854 | A | 1/1992 | Lonati |
| 5,167,566 | A | 12/1992 | Novitsky et al. |
| 5,171,182 | A | 12/1992 | Heinen |
| 5,339,657 | A | 8/1994 | McMurray |
| 5,479,791 | A | 1/1996 | Osborne |
| 5,553,468 | A | 9/1996 | Osborne |
| 5,590,548 | A | 1/1997 | Osborne |
| 5,592,836 | A | 1/1997 | Schuster et al. |
| 5,605,060 | A | 2/1997 | Osborne |
| 5,787,512 | A | 8/1998 | Knox |
| 6,276,175 | B1 | 8/2001 | Browder, Jr. |
| 6,287,168 | B1 | 9/2001 | Rabinowicz |
| 6,401,497 | B1 | 6/2002 | Nishiyama et al. |

*Primary Examiner*—Gloria M. Hale
(74) *Attorney, Agent, or Firm*—Ohlandt, Greeley, Ruggiero & Perle L.L.P.

(57) ABSTRACT

A circular knit bra is provided. The bra has a pair of breast cups, a central gore disposed between the breast cups, and a pair of side panels. Each of the breast cups has at least two different areas of stretchability. Each different area of stretchability has a different stitch density.

23 Claims, 4 Drawing Sheets

SEAMLESS CIRCULAR KNIT GARMENT WITH DIFFERENTIAL TIGHTNESS AREAS AND METHOD OF MAKING SAME

This is a continuation-in-part of patent application Ser. No. 10/093,077, filed Mar. 7, 2002 now U.S. Pat. No. 6,685,535.

BACKGROUND OF THE INVENTION

1. Field of the Invention

The present invention relates to brassieres and methods of making same. More particularly, the present invention relates to a circular knit bra having breast cups with varying degrees of stretch for providing desired, selective support to the wearer's breast.

2. Description of the Related Art

Modern brassieres are designed to accommodate both a need for comfort during wear, as well as a need for support. Therefore, a brassiere must provide both flexibility and freedom of movement, as well as breast support.

Circular knit bras have become popular for the maximum comfort and flexibility that they provide. Circular knit technology has been used to create brassieres that accommodate a need for maximum stretchability and freedom of movement, such as sports bras.

U.S. Pat. No. 4,531,525 to Richards describes the use of a circular knitting machine to produce a seamless garment blank. To assemble a brassiere, the seamless garment blank is cut, folded, and sewn.

U.S. Pat. No. 5,592,836 to Osborne describes a brassiere made from a circular-knit garment blank. Each circular-knit garment blank has a welt at one end with a fabric portion integrally knit thereto. To assemble the brassiere, neck and armhole areas are cut in the fabric segment to define front and rear strap portions, which are sewn to complete the formation of the brassiere. Full cup support areas are provided in each breast cup region by adding fed-in yarns in the knitting process.

U.S. Pat. No. 5,850,745 to Albright provides a circular knit brassiere that is elasticized by the selective insertion of elastic yarn segments in selected wales and courses, to define the contoured area to be elasticized.

U.S. Pat. No. 6,125,644 to Browder provides a circular knit brassiere formed of an inner fabric and an outer fabric that are knit to one another. The outer fabric is formed with yarn of nylon, or combinations of nylon and cotton, using a knit stitch to provide strength, support, or aesthetic properties in specific areas. The inner fabric is formed with yarns and one or more knit stitches that are selected or softness, comfort, and moisture wicking properties.

While brassieres of circular knit construction have become popular for the maximum comfort and flexibility desirable in an undergarment, they provide only limited support in the breast area. Moreover, in recent years there has been an increasing demand for brassieres having a shaping effect, i.e., which provide support in specific regions thereby improving the aesthetics of the figure.

Therefore, a need exists for a method of producing a brassiere having areas for providing support and shaping effect to the breasts using circular knitting machines.

SUMMRY OF THE INVENTION

It is an object of the present invention to provide a seamless circular knit bra or brassiere having areas for providing support and shaping in the breast cup area.

It is another object of the present invention to provide such a brassiere that has a breast cup with varied degrees of stretchability to enhance support and shaping effect to the breasts of the wearer.

It is yet another object of the present invention to provide such a brassiere in which the varied degrees of stretchability are discrete areas in the breast cup.

It is still another object of the present invention to provide such a brassiere in which the varied degrees of stretchability are achieved gradually throughout the breast cup.

It is still a further object of the present invention to provide a method of making a seamless circular knit bra or brassiere in which varying areas of stitch tightness and density are integrally knitted into the breast cups using a minimal number of manufacturing steps.

It is a still further object of the present invention to provide a method of making a seamless circular knit brassiere that uses select yarn feed-in tension while either changing, or still maintaining, the same basic stitch construction configuration throughout the brassiere.

These and other objects and advantages of the present invention are achieved by a bra or brassiere formed from a circular knit bra blank that is cut to define a traditionally shaped bra body having a pair of breast cups, a center gore or portion disposed between the breast cups, and a pair of side panels to connect each breast cup to the back of the brassiere. The brassiere may also include a pair of adjustable shoulder straps. Each strap is connected to a breast cup and a side panel. The brassiere may also have a pair of arcuate underwire portions, with one arcuate underwire portion adjacent or connected to each breast cup to provide additional breast support.

The brassiere of the present invention has breast cups with graded areas or graduation of stretch, preferably achieved by varying stitch density and stitch lengths, for providing support and shaping in the breast cup and, thus, to the breasts of the wearer.

In one embodiment, the stitching of each breast cup is most dense at the bottom of the breast cup. Two or more progressively less densely stitched areas are provided in the breast cup between the bra band and the top of the breast cup.

In another embodiment, the breast cup may have gradual gradation of stretchability, and thus stitch density. Preferably, stitch density at the bottom of the cup is most dense with stitch density gradually decreasing towards the top of the breast cup.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF THE INVENTION

Figure 1:
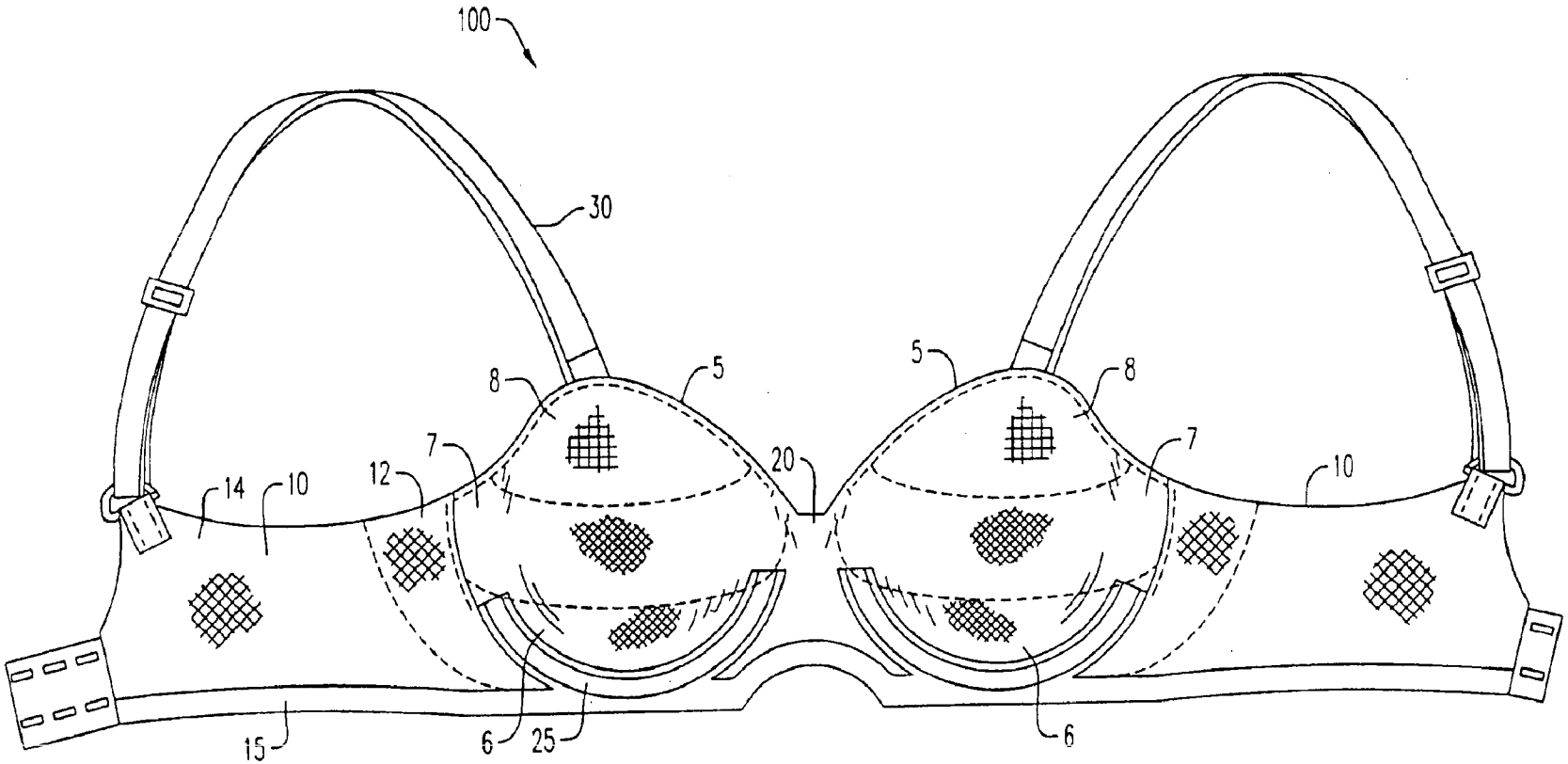
FIG. 1 is a top view of a brassiere of a preferred embodiment according to the present invention.
Figure 3:
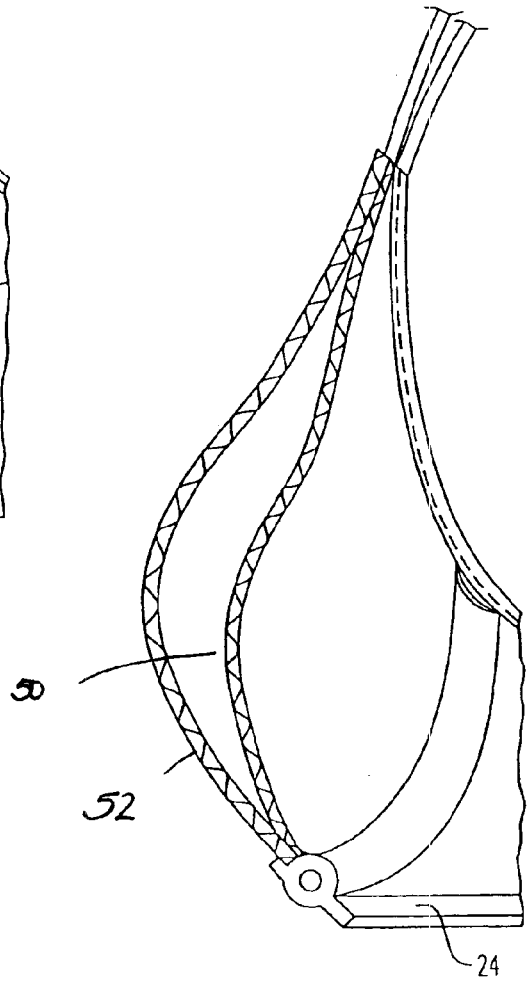
FIG. 3 is a side view of an alternative embodiment of a breast cup of a brassiere of the present invention.

Referring to the drawings and, in particular, FIG. 1, there is illustrated a bra or brassiere according to the present invention generally represented by reference numeral 100. Brassiere 100 is preferably formed from a single layer of fabric. However, brassiere 100 may have two or more layers. Also, the breast cup of brassiere 100 may be formed of two or more layers as shown in FIG. 3.

According to the present invention, a bra blank is formed on a circular knitting machine preferably having a computerized electronic needle and yarn feed selection system. The knit construction of the body of the brassiere 100 may be formed using one or any combination of conventional knit stitches. Such stitches include, but are not limited to, plain, tuck or float stitches.

The outline of brassiere 100 is cut from the bra blank using a sewing machine that simultaneously cuts away and finishes the periphery of brassiere 100 to provide a pair of breast cups 5, a center gore or panel 20 positioned between the breast cups, and a pair of side panels or portions 10. Each side panel 10 is adjacent to a different breast cup and is adapted to be connected to the other side panel.

Side panels 10 are removably joined together at the back of the wearer by conventional fasteners, such as, for example, hook-and-eye, snap and hook and loop VELCRO™ closures. The closures are adjustable to accommodate the size of the wearer. While not preferred, the closure can be in gore panel 20 at the front of the brassiere, instead of at the back panel.

An alternate embodiment of brassiere 100 is shown in FIG. 3. The alternate embodiment has an inner layer 50 and an outer layer 52. Inner layer 50 and outer layer 52 may be formed from one integrally knit brassiere blank that is folded upon itself to form a two-layered brassiere. Alternatively, inner layer 50 and outer layer 52 may be formed from two separately knitted fabric pieces. It should be noted that brassiere 100 may have three or more layers including foam or other support means.

Inner layer 50 may have a uniform knit density. Alternatively, inner layer 50 may have a central gore or panel having a greater stitch density than the area surrounding the central gore. In yet another embodiment, inner layer 50 may have a pair of breast cups and a pair of side panels or portions, each side panel being adjacent to a different breast cup and adapted to be connected to the other side panel. In an embodiment in which inner layer 50 has a pair of breast cups and a pair of side panels or portions, the breast cups or the side panels may have knitted-in support areas having increased stitch density.

Brassiere 100 preferably has a pair of shoulder straps 30 each connected to a different one of a pair of breast cups 5 and side panels 10. The shoulder straps 30 preferably are adjustable. However, the present invention can be practiced on a strapless brassiere.

Brassiere 100 may also have an anchoring chest band 15 disposed on the bottom margin of the brassiere. Preferably, anchoring chest band 15 is a turned welt formed in the circular knitting process in a well-known manner.

Brassiere 100 may also have an underwire 25. In another embodiment, brassiere 100 may have a heat shrinkage yarn that can be formed to be a support that can act as underwire. Preferably, the heat shrinkage yarn is formed by splicing in during knitting a specific area selected in order to provide the support.

Figure 2:
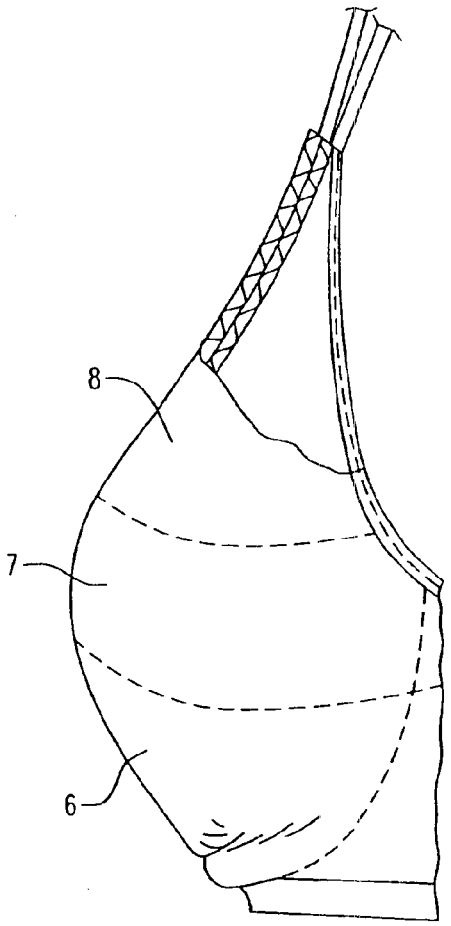
FIG. 2 is a side view of the brassiere of FIG. 1.

As shown in FIGS. 1 and 2, breast cups 5 have areas or degrees of varying stretchability for providing support and shaping effect to the breast cups. Referring to FIG. 2, the varying areas or degrees of stretchability in each breast cup is achieved by varying stitch density and stitch lengths. In a preferred embodiment, stretch density is the tightest in the area of the breast cup that is immediately adjacent to anchoring chest band 15 where the greatest support is needed. One or more areas of progressively less dense stitching are provided with the lowest stitch density in breast cup 5 being located at the top portion of the breast cup.

In an alternative embodiment shown in part in FIG. 3, each breast cup 5 can also have gradual varying stretchability. Preferably, the varying stretchability is achieved, again through stitch density, and again preferably with the greatest density stitch being at the lowermost point of the breast cup.

Brassiere 100, including each breast cup 5, is formed on a circular knit machine using a plain jersey stitch in a manner well known in the art. The software used to run the circular knit machine allows an operator to assign a stepping motor value, which corresponds to the knit yarn tension of the knitted fabric. Areas of increased stitch density, in order to provide support and shaping effect to breast cups 5 and thus the breasts of the wearer, are formed by increasing the knit tension, thereby forming shorter stitch lengths. This increase in stitch tension reduces the stitch length in specific areas or portions of breast cups 5 to create areas of increased stitch density, and thus tightness or support. However, support areas in breast cups 5 may also be created using miss stitching or tuck stitching in a manner well known in the art. The varying areas of stitch density or tightness may be distinct zones as incremental zones shown in FIG. 2, or graduated zones shown in FIG. 3.

Figure 4:
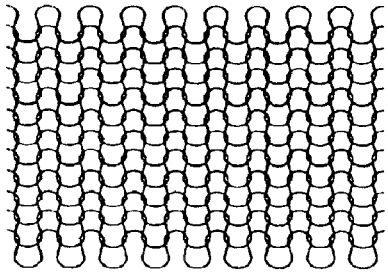
FIG. 4 is the stitch of highest density, having shorter stitch lengths, of a breast cup of a brassiere of the present invention.
Figure 5:
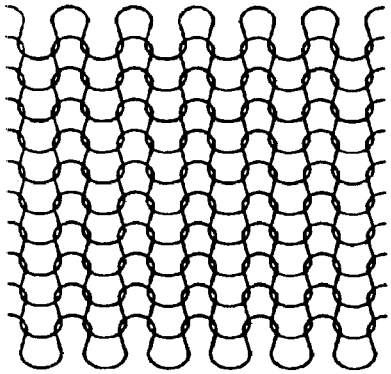
FIG. 5 is the stitch of intermediate density, having longer stitch lengths, of the breast cup of the brassiere of the present invention.
Figure 6:
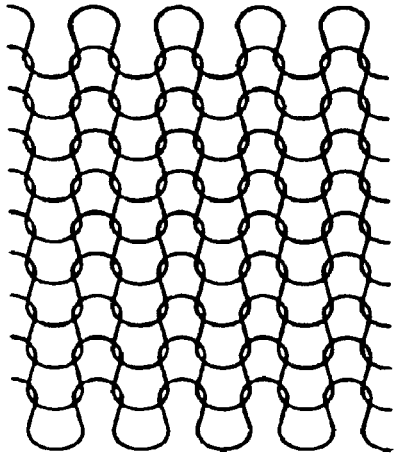
FIG. 6 is the stitch of least density, having the longest stitch lengths, of the breast cup of the brassiere of the present invention.
Figure 7:
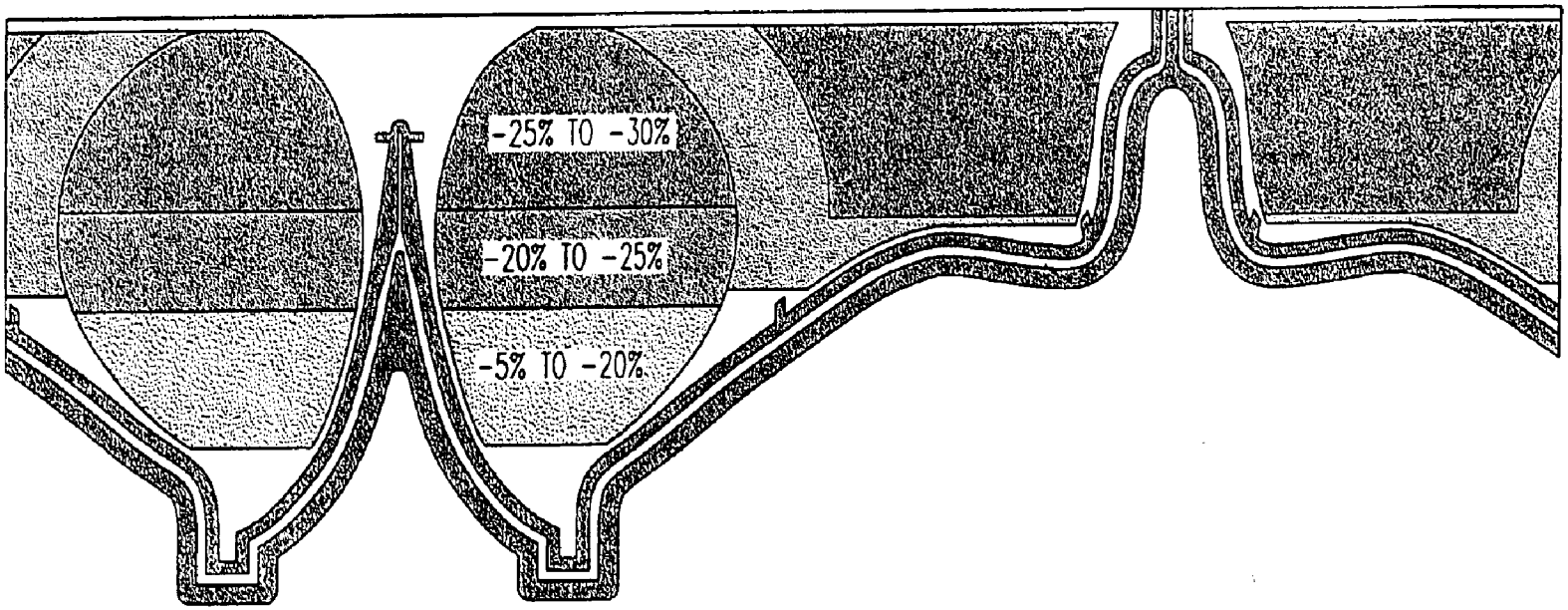
FIG. 7 is a schematic view of the differential tightness areas of the brassiere of the present invention.

FIG. 1 illustrates a preferred embodiment of the present invention. Breast cup 5 has three distinct areas of stitch density. A lower breast cup area 6, located immediately adjacent to anchoring chest band 15, is knitted using a stepping motor value of −30 on a circular knit machine Model No. SM8-8, manufactured by Santoni® of Brescia, Italy. The stitch or fabric of lower breast cup area 6 is shown in FIG. 4. An intermediate breast cup area 7 is knitted using a stepping motor value of −25. The stitch of intermediate breast cup area 7 is shown in FIG. 5. An upper breast cup area 8, located immediately adjacent to shoulder strap 30, is knitted using a stepping motor value of −20. The stitch of upper breast cup area 8 is shown in FIG. 6.

Tests were performed to determine the cross stretch of the fabric of the varying areas 6 through 8 of stitch density or tightness of breast cup 5. Brassiere blanks were knitted using stepping motor values corresponding to the stepping motor values used in breast cup areas 6 through 8. A bra blank was also formed using the stepping motor zero point value of 60 on the Santoni® machine. This blank was used as a baseline zero point for fabric cross stretch tests. At a stepping motor value of 60, the cross stretch of the fabric was 32.3 inches.

Lower breast cup area 6 had a cross stretch of 24 inches, a −26% difference from the baseline value of 32.3 inches. A negative stitch value of −26% indicates a 26% tighter and shorter stitch length than that of the body baseline zero point quality. Preferably, the cross stretch of lower breast cup area 6 ranges between about −25% to about −30% from the baseline value. More preferably, the cross stretch of lower breast cup area 6 is −26% from the baseline value.

Intermediate breast cup area 7 has a cross stretch of 25.5 inches, a −22% difference from the baseline value of 32.3 inches. Preferably, the cross stretch of intermediate breast cup area 7 ranges between about −20% to about −25% from the baseline value. More preferably, the cross stretch of intermediate breast cup area 7 is −22% from the baseline value.

Upper breast cup area 8 has a cross stretch of 26.6 inches, which is a −18% difference from the baseline value of 32.3 inches. Preferably, the cross stretch of upper breast cup area 8 ranges between about −15% to about −20% from the baseline value. More preferably, the cross stretch of upper breast cup area 8 is −18% from the baseline value.

In any embodiment of the present invention, the graded areas of stitch density of breast cup 5 preferably are more densely knit than side panels 10. In the preferred embodiment of the present invention, each side panel 10 has distinct areas of varying stitch density or tightness. A crescent shaped area 12 of comparatively loose stitch density is located in the portions of side panels 10 immediately adjacent to breast cups 5. The terminal portion 14 of side panel 10 is less densely knit than crescent area 12 and less densely knit than any of breast cup areas 6 through 8.

In an alternate embodiment of the present invention, each side panel 10 is knitted using a single, consistent stitch density or tightness. The stitch density of each side panel 10 is lower than that of any breast cup support area.

Underwire support may be provided by an arcuate underwire 25. The lower breast cup area 6 of breast cups 5 provide direction for the placement of underwire 25, which is preferably separately sewed to the breast cups. The underwire 25 may be disposed in an arcuate fabric tube, thereby providing increased comfort to the wearer. The lower breast cup areas 6 of breast cups 5 adjoin underwire 25, thereby forming the bottom edges of the breast cups. In a multi-layer embodiment of the present invention, underwire 25 may be sandwiched between the layers of brassiere 100 and secured to breast cups 5 by sewing, gluing or other fastening means.

To provide aesthetic and recognizable characteristics to a finished brassiere, the blank may have knitted-in patterns on breast cups 5 and on side panels 10. Such decorations may include, but are not limited to, floral, abstract or other designs.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A circular knit bra comprising:

a pair of breast cups, each of said pair of breast cups having a bottom edge and a top edge; and a pair of side panels, each of said pair of side panels being adjacent to a different one of said pair of breast cups, wherein each of said breast cups has at least two different stitch densities thereby providing at least two different support areas, wherein said at least two support areas are formed by varying stitch length.

2. A circular knit bra comprising:

a circularly knitted outer layer having a pair of breast cups, each of said pair of breast cups having a bottom edge and a top edge; and a pair of side panels, each of said pair of side panels being adjacent to a different one of said pair of breast cups; and a circularly knitted inner layer, wherein each of said first layer breast cups has at least two different stitch densities thereby providing at least two different support areas, wherein said at least two support areas are formed by varying stitch length.

3. The bra of claim 2, wherein said inner layer has a pair of breast cups, each of said pair of breast cups having a bottom edge and a top edge, and a pair of side panels, each of said pair of side panels being adjacent to a different one of said pair of breast cups.

4. The bra of claim 2, wherein said at least two support areas are formed using one or more stitches selected from the group consisting of a plain, tuck, and float stitch.

5. The bra of claim 2, wherein said brassiere is knitted using plain stitches.

6. The bra of claim 2, wherein said at least two support areas are formed by shorter stitch lengths.

7. The bra of claim 2, wherein said at least two support areas is at least three support areas.

8. The bra of claim 2, wherein said at least two support areas is three areas of support.

9. The bra of claim 8, wherein said three areas of support each have a different stitch density.

10. The bra of claim 8, wherein said three area of support are a first, second and third areas of support.

11. The bra of claim 8, wherein said first area of support has a cross stretch in the range about −25% to about −30% of a baseline of zero.

12. The bra of claim 8, wherein said first area of support has a cross stretch is −26% of the baseline.

13. The bra of claim 8, wherein said second area of support has a cross stretch in the range about −20% to about −25% of a baseline of zero.

14. The bra of claim 8, wherein said second area of support has a cross stretch of −22% of the baseline.

15. The bra of claim 8, wherein said third area of support has a cross stretch in the range about −5% to about −20% of a baseline of zero.

16. The bra of claim 8, wherein said third area of support has a cross stretch of −8% of the baseline.

17. The bra of claim 2, wherein said at least two areas of support comprise graded stitch differentiation.

18. The bra of claim 2, wherein said at least two areas of support comprise distinct zones of stitch differentiation.

19. The bra of claim 2, wherein said inner layer and said outer layer are formed of an integrally knit brassiere blank.

20. The bra of claim 2, wherein said inner and said outer layers are separate knit pieces.

21. The bra of claim 2, wherein said inner layer has a knitted-in gore area.

22. The bra of claim 3, wherein each of said inner layer breast cups has at least two different stitch densities thereby providing at least two different support areas, wherein said at least two support areas are formed by varying stitch length.

23. The bra of claim 22, wherein said inner layer at least two areas of support comprise graded stitch differentiation.

* * * * *